US008832913B2

(12) United States Patent
Kajiwara et al.

(10) Patent No.: US 8,832,913 B2
(45) Date of Patent: Sep. 16, 2014

(54) LACE PROVIDED WITH TUBULAR LACE BODY

(71) Applicant: Twins Corporation, Chiba (JP)

(72) Inventors: Ryuji Kajiwara, Chiba (JP); Masakazu Osada, Hong Kong (CN); Liming Yang, Guang Dong (CN); Tsung Jen Hsieh, Guang Dong (CN)

(73) Assignees: Twins Corporation, Chiba (JP); Masakazu Osada, Hong Kong (CN); Liming Yang, Guang Dong (CN); Tsung Jen Hsieh, Guang Dong (CN)

( * ) Notice: Subject to any disclaimer, the term of this patent is extended or adjusted under 35 U.S.C. 154(b) by 0 days.

(21) Appl. No.: 13/750,236

(22) Filed: Jan. 25, 2013

(65) Prior Publication Data

US 2014/0007392 A1 Jan. 9, 2014

(30) Foreign Application Priority Data

Jul. 4, 2012 (JP) ..... 2012-150880

(51) Int. Cl.
*A43C 1/02* (2006.01)
*A43C 9/00* (2006.01)

(52) U.S. Cl.
CPC ..... *A43C 9/00* (2013.01)
USPC ..... 24/715.3

(58) Field of Classification Search
USPC ..... 24/712, 712.7, 300, 715.3; 87/6, 9
See application file for complete search history.

(56) References Cited

U.S. PATENT DOCUMENTS

| | | | | |
|---|---|---|---|---|
| 5,934,168 | A * | 8/1999 | Feichtinger et al. | 87/8 |
| 6,513,210 | B1 * | 2/2003 | Gonzalez | 24/712 |
| 7,331,269 | B2 * | 2/2008 | He et al. | 87/6 |
| 2012/0232655 | A1 * | 9/2012 | Lorrison et al. | 623/13.19 |
| 2012/0295046 | A1 * | 11/2012 | Levesque | 428/36.3 |
| 2013/0125739 | A1 * | 5/2013 | Kinugasa | 87/9 |
| 2013/0255045 | A1 * | 10/2013 | Gonzalez | 24/715.3 |

FOREIGN PATENT DOCUMENTS

| | | |
|---|---|---|
| JP | 56-021862 | 5/1981 |
| JP | 2002-541352 | 12/2002 |

* cited by examiner

*Primary Examiner* — Victor Batson
*Assistant Examiner* — Matthew Sullivan
(74) *Attorney, Agent, or Firm* — Pearne & Gordon LLP

(57) ABSTRACT

In the conventional lace with knobby portions having elastic rubber core, there is difference in degree of stretch between both ends and core of the knobby portion. Therefore, there are a portion that is subjected to heavy stretching force and a portion that is subjected to no stretching force, and when large strain is accumulated at the boundary between the portions subjected to different stretching forces and the strain reaches the limit, the lace ruptures. In order to solve the above problem, we provide a lace provided with tubular lace body of elastic material, comprising knobby portions repeatedly placed at intervals, of which diameter vary depending on tension on the knobby portion in an axial direction.

11 Claims, 7 Drawing Sheets

W1>1. 5×W2

W3<1. 3×W4

LACE PROVIDED WITH TUBULAR LACE BODY

BACKGROUND OF THE INVENTION

1. Field of the Invention

The present invention relates to a lace provided with a tubular lace body.

2. Description of the Related Art

Conventionally, as to a lace which needs to be pass through a hole for fixation, a lace, where its core is made of a linear material having elasticity such as a rubber, the outer periphery of the core is covered with fiber, and the fiber portion has knobby portions for hooking into holes of a lace-up shoes, thereby being fixed without lacing, is well-known.

The knobby portions are braided so as to hook the hole after passing through the hole of the lace-up shoes, and can freely vary its diameter depending on the tension put on the lace. Therefore, the lace has a configuration, where a plurality of knobby portions, of which ends are fixed by the rubber of the core, and the core which is inelastic (flexible) and not fixed, are braided and placed. When a tension is put on the core of rubber, the rubber portion extends and the distance between the ends extends, so that the core of the knobby portion becomes flat, and the diameter becomes smaller.

Moreover, when the tension is not put on the lace, the rubber portion becomes normal length, and the distance between the ends also becomes normal, so that the shape of the knobby portion is restored to be original, and the diameter becomes greater.

Thus, it is possible to control variation of the diameter of the knobby portion by the tension put on the lace, so that the shoe lace which does not loosen without lacing can be made as described above.

For example, the Japanese Patent No. 3493002 discloses such lace provided with knobby portions.

3. Related Art Documents

Patent Document 1: Japanese Patent No. 3493002

However, in the above technology, the both ends of the inelastic knobby portion are fixed to the rubber core, so that the rubber portion cannot extends under high tension. The reason is that the knobby portion is braided by the inelastic fiber and the rubber portion is fixed by the inelastic.

Moreover, the rubber portion corresponding to the core of the knobby portion repeats extension and shrinks in response to the high tension.

SUMMARY OF THE INVENTION

Therefore, there are a portion that is subjected to heavy stretching force and a portion that is subjected to no stretching force, and when large strain is accumulated at the boundary between the portions subjected to different stretching forces and the strain reaches the limit, the lace ruptures. In order to solve the above problem, we provide a lace provided with tubular lace body of elastic material, comprising knobby portions repeatedly placed at intervals, of which diameter vary depending on tension on the knobby portion in an axial direction.

According to the present invention mainly having the above configuration, the lace having an economical advantage, which is not easily torn and does not get loose without lacing, can be provided.

DESCRIPTION OF THE PREFERRED EMBODIMENTS

Embodiments of the present invention will be described hereinafter. Relationship between Claims and Embodiments is as follows. The first embodiment will mainly describe Claim 1. The second embodiment will mainly describe Claim 2. The third embodiment will mainly describe Claim 3. The fourth embodiment will mainly describe Claim 4. The fifth embodiment will mainly describe Claim 5. The sixth embodiment will mainly describe Claim 6. The present invention is not to be limited to the above embodiments and able to be embodied in various forms without departing from the scope thereof.

First Embodiment

Outline of First Embodiment

Figure 1:
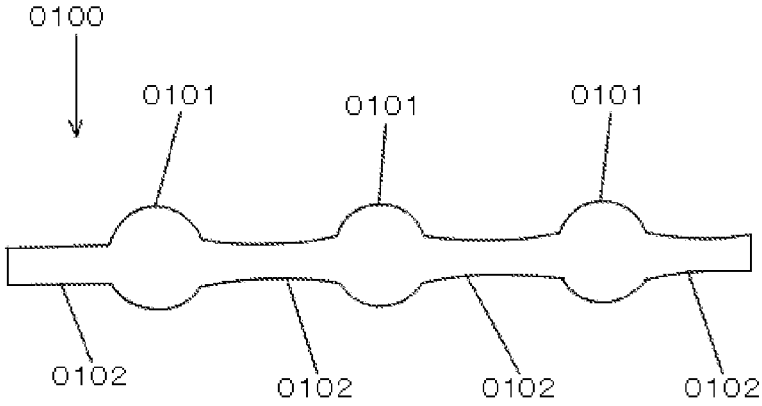
FIG. 1 is a diagram showing a portion of a lace of a first embodiment.

FIG. 1 is a diagram showing a portion of a lace of a first embodiment. As shown in FIG. 1, the lace of the first embodiment is a lace provided with tubular lace body of elastic material, comprising a knobby portion repeatedly placed at intervals, of which diameter varies depending on tension on the knobby portion in an axial direction. This configuration enables to provide a lace which is not easily torn under high tension which is repeatedly put on the lace body.

Figure 11:
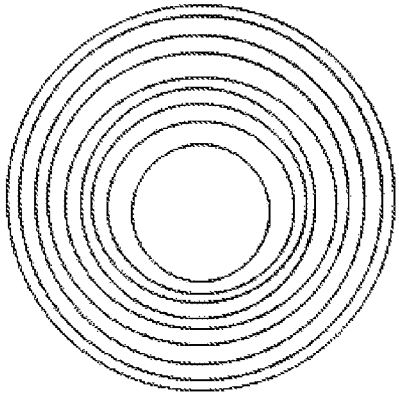
FIG. 11 is a side view of both sides of the lace of the present invention.

Note that the design of the lace of FIG. 1 continues only in horizontal direction in the elevation view, and FIG. 11 is a side view of both sides of the lace of the present invention.

Configuration of First Embodiment

Figure 2:
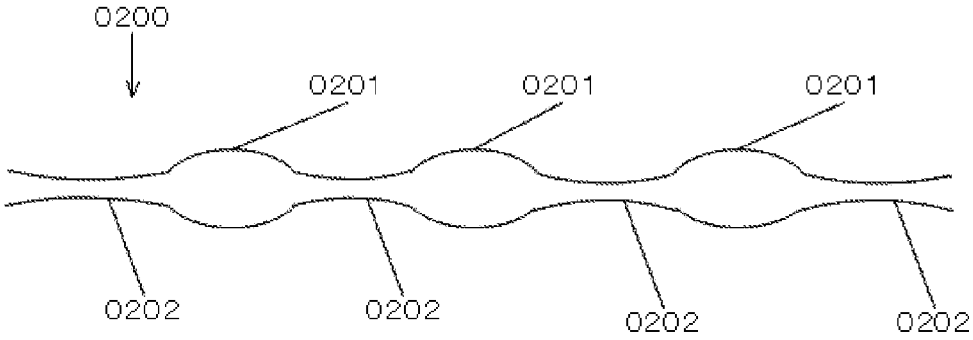
FIG. 2 is a diagram showing that the lace of the first embodiment is under tension in an axial direction.

As shown in FIG. 1, a 'lace' 0100 of a first embodiment is a lace provided with tubular lace body comprising knobby portions repeatedly placed at intervals. Specifically, the knobby portions are configured by repeated placed 'cores' 0101, and 'ends' 0102. FIG. 2 is a diagram showing that the lace of the first embodiment is under tension in an axial direction. As shown in FIG. 2, when putting the tension in the axial direction, the diameter of the knobby portion varies, such that the knobby portion shrinks. When removing the tension in the axial direction, the diameter of the knobby portion varies, such that the knobby portion expands.

The 'knobby portion' of the first embodiment is 'repeatedly placed at intervals'. Therefore a plurality of knobby portions is placed on the lace body. The plurality of knobby portions may be placed only with intervals between the cores, and the interval is not necessary to be regular. Therefore, the knobby portion may be placed at regular intervals or at random, and the interval is design variation. As show in FIGS. 3 and 4, it is possible to provide laces for various cases such as a case of lacing up shoes or a case of fastening trousers.

Moreover, as to the knobby portion, 'diameter varies depending on tension on the knobby portion in an axial direction'. Specifically, as the tension in the axial direction increases, the diameter is reduced, and as the tension in the axial direction decreases, the diameter increases.

Figure 5:
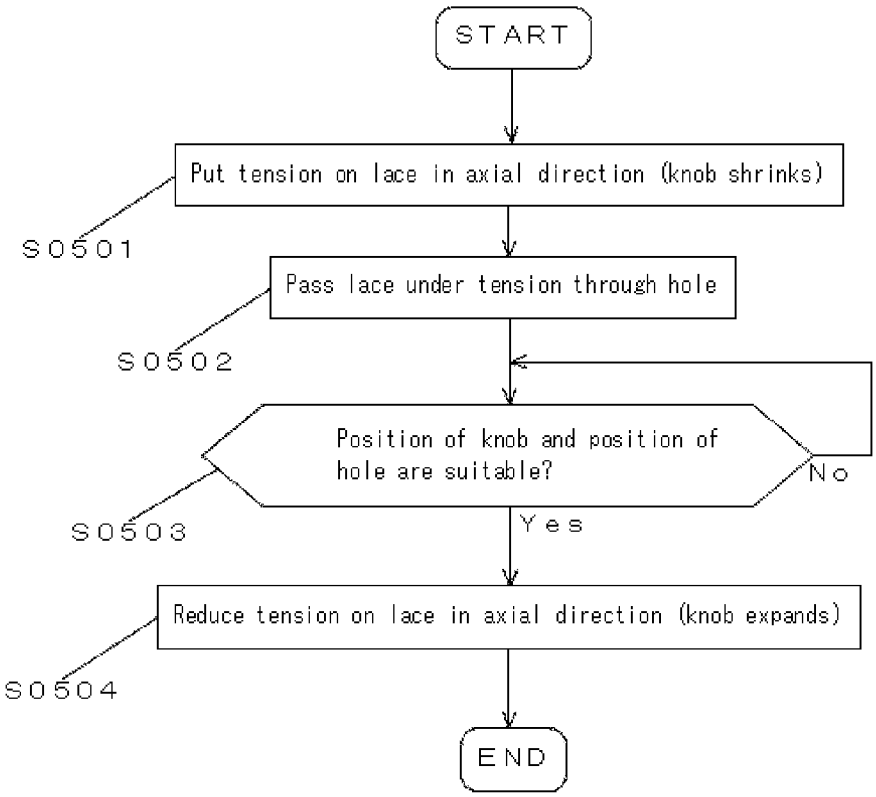
FIG. 5 is a flowchart of fixing process by using the lace of the first embodiment.

FIG. 5 is a flowchart of fixing process by using the lace of the first embodiment. The process includes the following steps. At the outset, in a step S0501, tension on the lace is put in an axial direction, such that the diameter of the knobby portion is reduced. Subsequently, in a step S0502, the lace under tension is made to pass through a hole. Subsequently, in a step S0503, it is determined whether lace length is suitable for keeping fixed state. If the length is not suitable, the step S0502 is repeated. If it is determined that the length is suitable, processing shifts to a step S0504. Subsequently, in a step S0504, the tension put on the lace is reduced, such that the diameter of the knobby portion increases, thereby expanding the knobby portion. Thus, it is possible to keep the state of being fixed only by hooking the knobby portion on the hole without lacing.

Note that the 'knobby portion' of the present invention is a portion having diameter greater than that of a non-knobby portion with no tension in the axial direction. Therefore, the knobby portion is a part of the lace body, and configured by the after-mentioned elastic material similar to the lace body.

Figure 12:
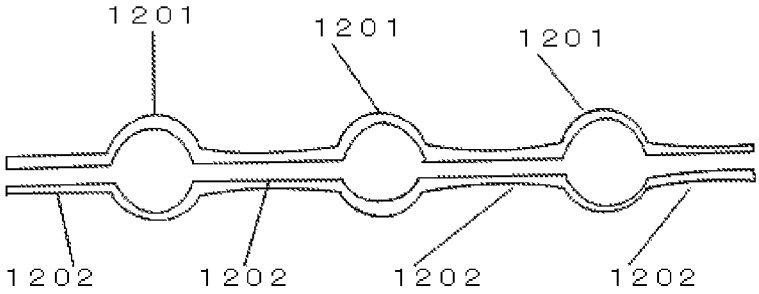
FIG. 12 is a cross-sectional view when the lace of the present invention is configured to be a rubber tube.

The terms 'configured by the elastic material' means that the lace is configured by a material having a property of elasticity. Examples of the elastic material include natural rubber and synthetic rubber. The lace may be configured to be rubber tube as shown in FIG. 12 by singularly using such material, or may be configured by combination of such materials and inelastic materials such as polyester, nylon, acryl or polyurethane. Therefore, according to this configuration where the entire lace body made of elastic material, the entire lace body can extend and shrink under tension in the axial direction, so that distortion is not easily caused on the respective portions of the lace, thereby providing the lace which is not easily torn under high tension which is repeatedly put on the lace body.

Effects of First Embodiment

According to the lace of the first embodiment having the above configuration, the lace can preserve the knobby portion under high tension, and can be repeatedly used, thereby solving the problem of the conventional technology.

Second Embodiment

Outline of Second Embodiment

Figure 6:
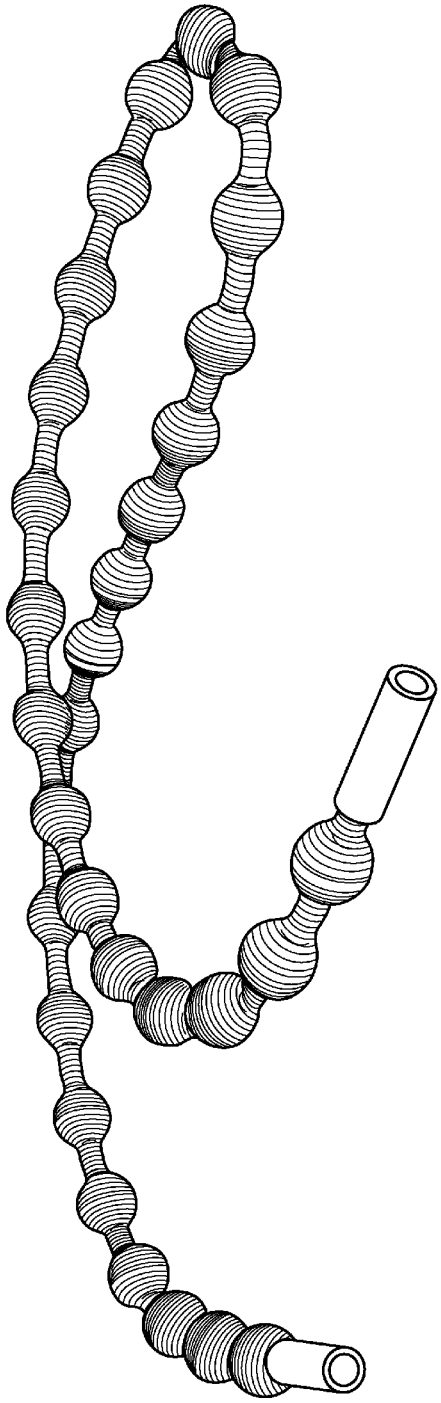
FIG. 6 is a perspective view of an entire lace of a second embodiment.

FIG. 6 is a perspective view of an entire lace of a second embodiment. As show in FIG. 6, the lace of the second embodiment is basically similar to that of the first embodiment, and the elastic material is braided by rubber and less-elastic normal material. This configuration enables extension and shrink in the axial direction without heavy load for the lace.

Functional Configuration of Second Embodiment

The configuration of the lace of the second embodiment is basically similar to that of the first embodiment as described with reference to FIG. 1. Hereinafter, description of difference in configuration of the elastic material is mainly provided.

The 'rubber-like material' is a material having elasticity and a thread-like shape, and can well expand under tension in the axial direction. Note that the term 'rubber-like material' does not exclude a rubber material, and therefore, includes any type of rubber such as natural rubber and synthetic rubber. The configuration braided by the rubber-like material enables sufficient extension with small tension in the axial direction.

The 'less-elastic normal material' is fiber material with less elasticity in comparison with the rubber-like material. Therefore, the term 'less-elastic' is a technical term and means 'poor in elasticity' and does not mean 'not elastic'. Examples of the less-elastic normal material include the polyester, nylon, acryl, and polyurethane. The configuration braided by such normal fiber materials with high line density enables to provide the lace with durability to tear. Moreover, using the normal material, it is possible to form various shape of knobby portions, which are hard to be formed in using only the rubber-like material.

The rubber-like material and the normal material configure the elastic material of the first embodiment by braiding them with each other. The term 'braiding' means general method for braiding the rubber-like material and the normal material in straight lines crossing each other diagonally. This configuration makes it possible to utilize both advantages of the rubber-like material and the normal material. Specifically, the rubber-like material is provided with durability to shrink and tear under strong tension in the axial direction by being braided with the normal material with high durability, and the normal material is provided with elasticity in the axial direction without heavy load by being braided with the rubber-like material.

Moreover, in the braiding, timing of crossing the materials and amounts of the materials to be used may be appropriately determined. Therefore, the ratio of the rubber-like material and the normal material may be equal, or may be 1:5 or 1:7 where the normal material is more used than the rubber-like material. Here, in order to secure the elasticity sufficient for performance of the lace of the first embodiment, for example, the suitable ratio between the rubber-like material and the normal material is approximately 1:7.

Hereinafter, a description of forming the knobby portion placed on the lace body of the first embodiment made by braiding the elastic material is provided. As described above, the knobby portion is necessary to be formed, such that the diameter thereof varies depending on tension on the knobby portion in an axial direction, and this function is necessary to be secured even in the braided configuration. Specifically, it is possible to make partial pitch variation in the braiding, for example, a portion of the lace may be loosely braided in comparison with other portions. This makes it possible to make deflection on the knobby portion, such that the knobby portion is more extendable, and to configure the lace body by the rubber-like material and normal material without patch of separately braided materials at the core and the end of the knobby portion.

Effects of Second Embodiment

According to the lace using the normal material of the second embodiment, in addition to the first embodiment, it is possible to provide laces of various designs, and to provide the lace not only with durability to tear. Moreover, the normal material reduces friction drag with the hole, and provides the lace with smoothness in moving.

Third Embodiment

Outline of Third Embodiment

Figure 7:
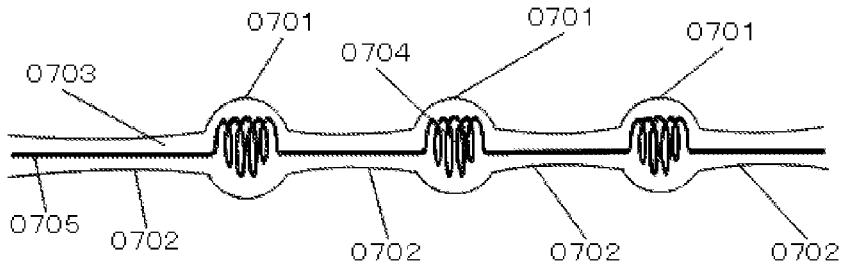
FIG. 7 is a cross-section view of a lace of a third embodiment.

FIG. 7 is a cross-section view of a lace of a third embodiment. As show in FIG. 7, the lace of the third embodiment is basically similar to that of the first embodiment, and further comprises a 'centrally-placed lace' 0705 that is centrally placed in a 'tube' 0703 configured by tubular structure of the lace body, consists of less-elastic material, configures a core of the knobby portion, and is balled up at a 'portion corresponding to knobby portion' 0704 so as to follow a variation of distance between ends of the knobby portion in response to the variation of the diameter of the knobby portion. According to this configuration, it is possible to reduce difficulty in restoring the original state of the knobby portion due to repeated use of the lace.

Configuration of Third Embodiment

The configuration of the lace of the third embodiment is basically similar to that of the first embodiment as described with reference to FIG. 1. Hereinafter, description of difference in configuration of the centrally-placed lace is mainly provided.

The 'centrally-placed lace' has a function of following a variation of distance between ends of the knobby portion in response to the variation of the diameter of the knobby portion, and is balled up at the portion corresponding to the knobby portion, thereby configuring the core of the knobby portion. The 'variation of distance between ends of the knobby portion in response to the variation of the diameter of the knobby portion' means that the variation of the diameter of the knobby portion is caused by the tension in the axial direction put the lace body, and the distance between ends of the knobby portion varies in response to the variation of the diameter. The 'function of following' the variation is, for example, when the distance between ends of the knobby portion is reduced, the after-mentioned balled-up portion of the centrally-placed lace further shrinks, and when the distance between ends of the knobby portion increases, the balled-up portion of the centrally-placed lace extends.

Here, the balled-up portion of the centrally-placed lace is made at the portion corresponding to the knobby portion. According to this configuration, the elastic material configuring the lace body forms the knobby portion along the portion corresponding to the knobby portion of the centrally-placed lace, so that the portion corresponding to the knobby portion works as the core for forming the knobby portion. Moreover, by internally placing the centrally-placed lace as the core, the knobby portion can preserve the firmness to endure the repeated use. Note that it is necessary to prevent position gap at the portion corresponding to the knobby portion in order to function the centrally-placed lace as the core of the knobby portion. In order to secure the function as the core of the knobby portion, it is required that the centrally-placed lace connects the respective portions corresponding to the knobby portion and has the thread-like form where it is fixed at the ends of the lace.

Note that since the centrally-placed lace is not necessary to extend or shrink the lace, the centrally-placed lace may be configured by inelastic material, not by elastic material. Therefore, even when putting the tension in the axial direction on the lace body and extending it, the centrally-placed lace does not extend like the rubber-like material. The centrally-placed lace has slightly longer than the lace body, and the 'balled-up portion' has, for example, a spirally-twisted form. According to this configuration, it is possible to reduce difficulty in restoring the original state of the knobby portion when the balled-up portion gets entangled in repeated use of the lace.

Effects of Third Embodiment

According to the lace having the configuration of the third embodiment, in addition to the first embodiment, it is possible to reduce difficulty in restoring the original state of the knobby portion of the lace body due to repeated use of the lace.

Fourth Embodiment

Outline of Fourth Embodiment

Figure 8:
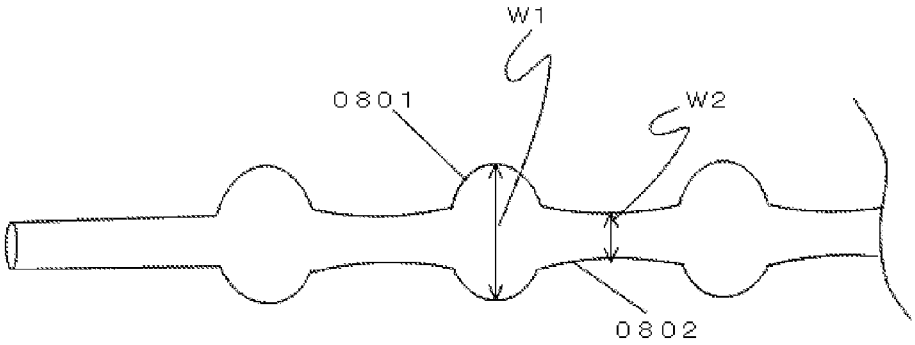
FIG. 8 is a cross-section view of a lace of a fourth embodiment.

FIG. 8 is a view showing an outline of a lace of a fourth embodiment. As show in FIG. 8, the lace of the fourth embodiment is basically similar to that of the first embodiment, and the diameter W1 of the 'core of the knobby portion' 0801 of the lace body is 1.5 times or more of the diameter W2 of the 'end of the knobby portion' 0802 of the lace body without tension in the axial direction. According to this feature in the shape of the knobby portion, the lace easily hooks on the hole, and can smoothly move upon adjusting its length.

Configuration of Fourth Embodiment

The configuration of the lace of the fourth embodiment is basically similar to that of the first embodiment as described with reference to FIG. 1. Hereinafter, description of difference in diameter of the knobby portion is mainly provided.

Figure 3:
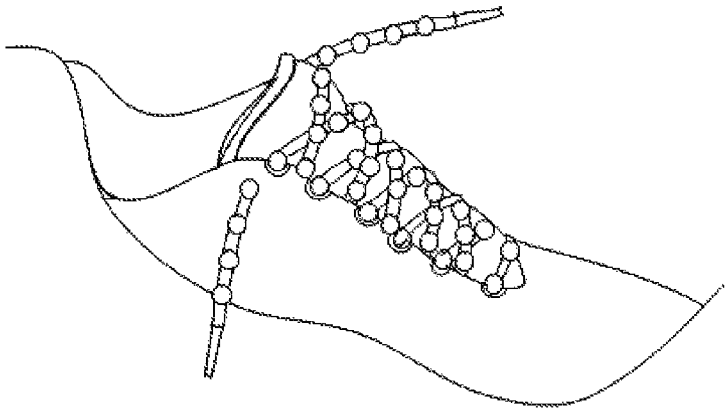
FIG. 3 is a diagram showing that the lace of the first embodiment is used for a shoe lace.
Figure 4:
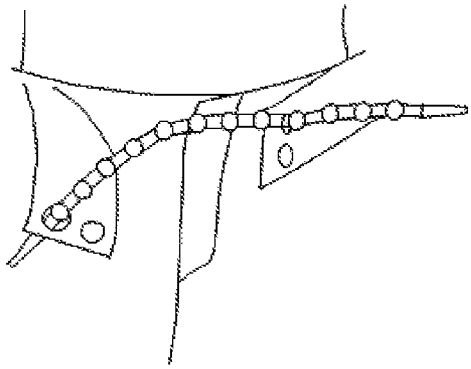
FIG. 4 is a diagram showing that the lace of the first embodiment is used for a lace for trousers.

The state 'without tension in the axial direction' is a state that tension on the lace does not exist. Under this state, for example as shown in FIG. 3, the core of the knobby portion has the diameter greater than the ends of the knobby portion, and functions as a fixture by being hooked on the hole. Therefore, for the function of the knobby portion, the diameter of the core of the knobby portion is required to be greater than that of the hole.

Meanwhile, when the diameter of the core of the knobby portion becomes excessively greater, the balance in the shape of the entire lace is lost, thereby spoiling the appearance of the lace. Moreover, it is necessary to put excessive tension in the axial direction on the lace to reduce the diameter of the core of the knobby portion and level the diameter of the entire lace. It is assumed that the lace is daily used as the fixture by men and women of all ages, it is preferable that the diameter of the core of the knobby portion varies with the minimum tension in the axial direction, such that elders and children who are less powerful can use the lace. Therefore, it is preferable that the knobby portion easily hooks on the hole, and the diameter of the entire lace is easily leveled.

In this regard, by using the lace of the present invention, where the diameter of the core of the knobby portion on the lace body was 7 mm, and the diameters of the ends were 4 mm, it was possible to reduce the diameter of the core of the knobby portion and to level the lace body without putting heavy tension in the axial direction.

Effects of Fourth Embodiment

According to the lace having the configuration of the fourth embodiment, in addition to the first embodiment, the lace easily hooks on the hole, and can smoothly move upon adjusting its length.

Fifth Embodiment

Outline of Fifth Embodiment

Figure 9:
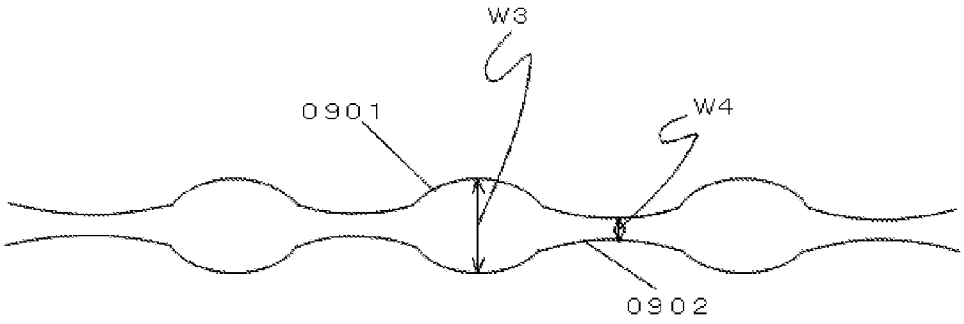
FIG. 9 is a cross-section view of a lace of a fifth embodiment.

FIG. 9 is a view showing an outline of a lace of a fifth embodiment. As show in FIG. 9, the lace of the fifth embodiment is basically similar to that of the first embodiment, and the diameter W3 of the 'core of the knobby portion' 0901 of the lace body is 1.3 times or less of the diameter W4 of the 'end of the knobby portion' 0902 of the lace body under tension in the axial direction. According to this feature in the shape of the knobby portion, the lace can smoothly passes through the hole.

Configuration of Fifth Embodiment

The configuration of the lace of the fifth embodiment is basically similar to that of the first embodiment as described with reference to FIG. 1. Hereinafter, description of difference in diameter of the knobby portion under tension is mainly provided.

The state 'under tension in the axial direction' is a state that tension is put on the lace. In this state, for example as shown in FIG. 2, the diameter of the core of the knobby portion becomes smaller than that of the state without tension in the axial direction, and the lace can pass thorough the hole without hooking. Therefore, for the function of the knobby portion, the diameter of the core of the knobby portion is required to be sufficiently small for passing through the hole under tension in the axial direction. It is ultimately preferable that the 'diameter sufficient small for passing through the hole under tension in the axial direction' is the same as that of the ends of the knobby portion. However, in the lace of the present invention, the elastic material is used for the lace body, and the lace has the tubular shape. Therefore, there is a room inside the tube, and if the diameter of the core of the knobby portion is slightly greater than that of the ends, the knobby portion extends to the room inside the tube upon passing through the hole, hereby passing the hole having the same diameter as that of the ends.

In this regard, by using the lace of the present invention, where the diameter of the core of the knobby portion on the lace body was 7 mm, and the diameters of the ends were 4 mm, it was possible to make the lace pass through the hole having 4 mm diameter by putting the tension in the axial direction on the lace even in the state that the diameter of the core of the knobby portion was approximately 5 mm.

Effects of Fifth Embodiment

According to the lace having the configuration of the fifth embodiment, in addition to the first embodiment, the lace can smoothly passes through the hole.

Sixth Embodiment

Outline of Sixth Embodiment

Figure 10:
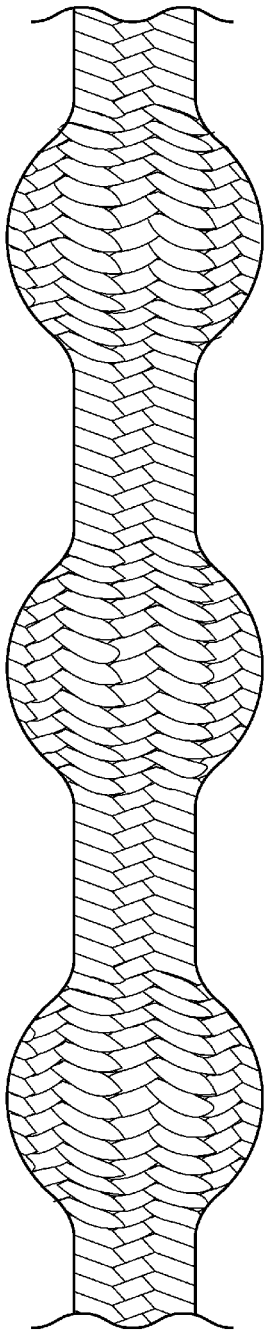
FIG. 10 is an enlarged view of a braided portion of a lace body of a sixth embodiment.

FIG. 10 is an enlarged view of a braided portion of a lace body of a sixth embodiment. As show in FIG. 9, the lace of the sixth embodiment is basically similar to that of the first embodiment, and the lace body is braided at 45 degrees angle to the axial direction. According to this feature, the lace can smoothly passes through the hole.

Configuration of Sixth Embodiment

The configuration of the lace of the sixth embodiment is basically similar to that of the first embodiment as described with reference to FIG. 1. Hereinafter, description of difference in braiding angle of the lace body is mainly provided.

As shown in FIG. 10, the terms 'the lace body is braided at 45 degrees angle to the axial direction' mean a state where the rubber-like material and the normal material are braided at approximately 45 degrees angle. As described above, it is preferable that the lace body can pass through the hole without hooking, and degree of the hooking can vary depending not only on the diameter of the knobby portion but also on surface shape of the knobby portion. Specifically, as the surface shape of the knobby portion gets smooth, the lace body can easily pass through the hole. Here, as the braiding angle gets wide, the braiding gets loose, thereby the lace easily hooks on the hole. Meanwhile, as the angle gets narrow, the diameter of the lace body is reduced, the diameter of the knobby portion relatively becomes greater, and it becomes difficult to make the diameter of the knobby portion small and to make the lace pass through the hole unless heavy tension in the axial direction is put on the lace.

In this regard, by using the lace of the present invention, where the lace body is braided by the rubber-like material and the normal material at approximately 45 degrees angle to the axial direction, it is possible to make the lace smoothly pass through the hole without causing the above problem.

Effects of Sixth Embodiment

According to the lace having the configuration of the fifth embodiment, in addition to the first embodiment, the lace can smoothly passes through the hole.

DESCRIPTION OF REFERENCE NUMERALS

0100 Lace
0101 Core of knobby portion
0102 End of knobby portion
0103 End
0200 Lace
0201 Core of knobby portion
0202 End of knobby portion
0701 Core of knobby portion
0702 End of knobby portion
0703 Tubular portion
0704 Portion corresponding to knobby portion
0705 Centrally-placed lace
1201 Core of knobby portion
1202 End of knobby portion

The invention claimed is:

1. A lace comprising:

a tubular lace body comprising a plurality of knobby portions and a plurality of tube portions;

the knobby portions repeatedly placed at intervals along the length of said body, each of said knobby portions comprising a diameter and separated from one another by a distance defining said intervals, the tube portions placed at the intervals and adjacent to the knobby portions; and a centrally-placed lace being centrally placed within the tube portions and the knobby portions of the tubular lace body, the centrally-placed lace defining a plurality of cores balled up within each of said knobby portions and extending within said tube portions;

said tubular lace body is comprised of a first elastic material and a second fiber material;

wherein the second material comprises an elasticity that is less than the elasticity of a first material; and wherein when said lace is placed under tension, said diameters of said knobby portions and said tube portions each undergo a variation.

2. The lace according to claim 1, wherein the elastic material is braided by the first material and the second material.

3. The lace according to claim 1, wherein the diameter of the knobby portion of the lace body is 1.5 times or more of that of a non-knobby portion of the lace body without tension in the axial direction.

4. The lace according to claim 1, wherein the diameter of the knobby portion of the lace body is 1.3 times or less of that of the non-knobby portion of the lace body under tension in the axial direction.

5. The lace according to claim 2, wherein the lace body is braided at 45 degrees angle to the axial direction.

6. The lace according to claim 2, wherein the diameter of the knobby portion of the lace body is 1.5 times or more of that of a non-knobby portion of the lace body without tension in the axial direction.

7. The lace according to claim 2, wherein the diameter of the knobby portion of the lace body is 1.3 times or less of that of the non-knobby portion of the lace body under tension in the axial direction.

8. The lace according to claim 3, wherein the diameter of the knobby portion of the lace body is 1.3 times or less of that of the non-knobby portion of the lace body under tension in the axial direction.

9. The lace according to claim 2, wherein the diameter of the knobby portion of the lace body is 1.5 times or more of that of a non-knobby portion of the lace body without tension in the axial direction, and wherein the lace body is braided at 45 degrees angle to the axial direction.

10. The lace according to claim 2, wherein the diameter of the knobby portion of the lace body is 1.3 times or less of that of the non-knobby portion of the lace body under tension in the axial direction, and wherein the lace body is braided at 45 degrees angle to the axial direction.

11. The lace according to claim 1, wherein the lace is configured to be materials selected from the group consisting of rubber tubing, inelastic materials, and a combination thereof, the inelastic materials comprising materials selected from the group consisting of polyester, nylon, acryl, polyurethane, and any combination thereof.

* * * * *